US010471491B2

(12) United States Patent
Otsuka

(10) Patent No.: US 10,471,491 B2
(45) Date of Patent: Nov. 12, 2019

(54) DIE-PRESSING PUNCH CAPABLE OF ADJUSTING INITIAL LOAD OF COIL SPRING IN ACCORDANCE WITH MATERIAL OF WORKPIECE, DIE-PRESSING DIE SET, AND BEVELING METHOD

(71) Applicant: AMADA HOLDINGS CO., LTD., Kanagawa (JP)

(72) Inventor: Yasuyuki Otsuka, Kanagawa (JP)

(73) Assignee: AMADA HOLDINGS., LTD., Kanagawa (JP)

( * ) Notice: Subject to any disclaimer, the term of this patent is extended or adjusted under 35 U.S.C. 154(b) by 0 days.

(21) Appl. No.: 16/321,248

(22) PCT Filed: Jul. 27, 2017

(86) PCT No.: PCT/JP2017/027162
§ 371 (c)(1),
(2) Date: Jan. 28, 2019

(87) PCT Pub. No.: WO2018/025735
PCT Pub. Date: Feb. 8, 2018

(65) Prior Publication Data

US 2019/0168276 A1 Jun. 6, 2019

(30) Foreign Application Priority Data

Aug. 5, 2016 (JP) ..... 2016-154235

(51) Int. Cl.
*B21D 19/00* (2006.01)
*B21C 51/00* (2006.01)
(Continued)

(52) U.S. Cl.
CPC ..... *B21D 19/00* (2013.01); *B21C 51/00* (2013.01); *B21D 22/02* (2013.01); *B21D 28/00* (2013.01); *B21D 28/34* (2013.01); *B21D 28/36* (2013.01)

(58) Field of Classification Search
CPC ..... B21D 5/14; B21D 13/04; B21D 17/04; B21D 19/00; B21D 19/04; B21D 37/04;
(Continued)

(56) References Cited

U.S. PATENT DOCUMENTS 5,555,759 A * 9/1996 Rosene ..... B21D 11/08 72/179
5,575,168 A * 11/1996 Rosene ..... B21D 11/08 72/179
(Continued)

FOREIGN PATENT DOCUMENTS

JP 09-052129 A 2/1997
JP 2002-178044 A 6/2002
(Continued)

OTHER PUBLICATIONS

International Search Report issued by International Bureau of WIPO in International Patent Application No. PCT/JP2017/027162, dated Oct. 10, 2017.
(Continued)

*Primary Examiner* — Edward T Tolan
(74) *Attorney, Agent, or Firm* — Greenblum & Bernstein, P.L.C.

(57) ABSTRACT

A die-pressing punch used for die-pressing a workpiece includes a punch guide, a punch body that is provided vertically movably and non-rotatable about its axial center with respect to the punch guide, a punch head screw-fitted with the punch head. The die-pressing punch further includes a roller unit that is provided inside the punch guide
(Continued)

beneath the punch body vertically movably and has a rotatable roller protruding downward from a bottom face of the punch guide, and an urging member that is provided between the punch body and the roller unit and urges the roller unit downward. The die-pressing punch further includes a joint member that is jointed with the punch head non-rotatably about the axial center, and an operable member. The operable member switches the joint member between a rotatable state and a non-rotatable state about the axial center with respect to the punch guide.

20 Claims, 14 Drawing Sheets

(51) Int. Cl.

| | |
|---|---|
| ***B21D 22/02*** | (2006.01) |
| ***B21D 28/00*** | (2006.01) |
| ***B21D 28/36*** | (2006.01) |
| ***B21D 28/34*** | (2006.01) |

(58) Field of Classification Search
CPC .... B21D 45/003; B21D 28/34; B21D 28/346; B21D 28/36; B21B 31/20; B21B 31/22
See application file for complete search history.

(56) References Cited

U.S. PATENT DOCUMENTS

| | | | | |
|---|---|---|---|---|
| 5,761,944 | A * | 6/1998 | Endo | B21D 17/04 72/133 |
| 5,839,341 | A | 11/1998 | Johnson et al. | |
| 6,131,430 | A * | 10/2000 | Schneider | B21D 17/04 72/75 |
| 7,168,364 | B2 * | 1/2007 | Schneider | B21O 51/005 101/26 |
| 7,367,210 | B2 * | 5/2008 | Nishibu | B21D 19/00 29/90.01 |
| 2006/0042341 | A1 | 3/2006 | Nishibu | |
| 2007/0034069 | A1 | 2/2007 | Endo | |

FOREIGN PATENT DOCUMENTS

| | | | |
|---|---|---|---|
| JP | 2006-095597 | A | 4/2006 |
| JP | 2007-038291 | A | 2/2007 |
| JP | 2014-087844 | A | 5/2014 |

OTHER PUBLICATIONS

Official Communication issued in Japan Patent Application No. 2016-154235, dated Sep. 29, 2007, along with an English translation thereof.
Official Communication issued in Japan Patent Application No. 2016-154235, dated Nov. 24, 2017, along with an English translation thereof.

* cited by examiner

DIE-PRESSING PUNCH CAPABLE OF ADJUSTING INITIAL LOAD OF COIL SPRING IN ACCORDANCE WITH MATERIAL OF WORKPIECE, DIE-PRESSING DIE SET, AND BEVELING METHOD

TECHNICAL FIELD

The present invention relates to a die-pressing punch used when carrying out die-pressing such as beveling or marking (engraving) to a workpiece, to a die-pressing die set, and to a beveling method.

BACKGROUND ART

Recently, various die-pressing punches are developed, and there is a Patent Document 1 as a prior art of die-pressing punches. Here, configurations of a die-pressing punch according to a prior art (conventional die-pressing punch) are explained.

A conventional die-pressing punch includes a hollow cylindrical punch guide, and the punch guide includes a punch body (punch driver) in its inside vertically movably (movably in a vertical direction). In addition, the punch guide includes, at its upper end portion, a ring-shaped punch head integrally therewith, and the punch head is to be pressed (struck) from above by a striker in the punch press.

The punch guide includes a roller unit on a lower side of the punch body in its inside vertically movably, and the roller unit includes a rotatable roller protruding downward from a bottom face of the punch guide. In addition, the punch guide includes, above the punch body in its inside, a spring urging the roller unit downward via the punch body.

PRIOR ART DOCUMENT

Patent Document

Patent Document 1: Japanese Patent Application Publication No. H9-52129

Here, a working load required for carrying out die-pressing adequately, such as beveling on a workpiece, is not constant generally, and varies according to materials of workpieces. In addition, it is impossible, in a conventional die-pressing punch, to adjust an initial urging force (initial load) of its coil spring. Therefore, there is a problem: it is required to adjust a height position of its striker and to set a working load according to a material of a workpiece every time when changing materials of workpieces, and thereby operations of die-pressing become cumbersome.

SUMMARY OF INVENTION

In order to provide a die-pressing punch that can solve the above problems and is configured by a new configuration, a die-pressing die set and a beveling method, an object of the present invention is to provide a die-pressing punch, a die-pressing die set and a beveling method each of which can improve operational efficiency of die-pressing such as beveling by adjusting an initial load of a coil spring according to a material of a workpiece.

Means for Solving Problems

According to a first aspect of the present invention, provided is a die-pressing punch used for die-pressing a workpiece, the die-pressing punch comprising: a hollow cylindrical punch guide; a punch body provided inside the punch guide vertically movably (movably in a vertical direction) and non-rotatable about an axial center thereof (axial center of the die-pressing punch) with respect to the punch guide; a punch head provided at an upper end of the punch body by being screw-fitted therewith; a roller unit provided inside the punch guide beneath (on a lower side of) the punch body vertically movably and having a rotatable roller protruding downward from a bottom face of the punch guide; an urging member provided inside the punch guide between the punch body and the roller unit and urging the roller unit downward; a ring-shaped joint member provided on a side of an outer circumferential surface of the punch body and on an upper side of the punch guide and jointed with the punch head non-rotatably about the axial center; and an operable member (a switcher member) for switching the joint member between a rotatable state and a non-rotatable state about the axial center with respect to the punch guide.

It is preferable that a plurality of engagement depressed portions depressed toward an outer side in a radial direction are formed on an inner circumferential surface of an upper end portion of the punch guide or on an inner circumferential surface of the joint member at intervals along a circumferential direction, and the operable member is provided on the joint member or at the upper end portion of the punch guide movably in the radial direction and has a hook portion capable of engaging with the engagement depressed portions.

It is preferable that the operable member disengages the hook portion from the engagement depressed portion by an pressing operation thereof to turn the joint member into the rotatable state about the axial center with respect to the punch guide, and engages the hook portion with any of the engagement depressed portions when the pressing operation is released to turn the joint member into the non-rotatable state about the axial center with respect to the punch guide.

It is preferable that the die-pressing punch further comprises a stripper spring provided between the punch head and the joint member on the side of the outer circumferential surface of the punch body for keeping a distance between the punch head and the punch guide in a vertical direction.

According to the first aspect of the present invention, the joint member is turned from the non-rotatable state to the rotatable state about the axial center with respect to the punch guide by the operable member. Then, the punch head is turned into its rotatable state about the axial center with respect to the punch guide (the punch body). Subsequently, by rotating the punch head, the punch body is slightly moved upward or downward (moved in the vertical direction) with respect to the punch guide (the punch head) due to a screw-fitting function of the punch head and the punch body. Further, the joint member is reset from the rotatable state to the non-rotatable state about the axial center with respect to the punch guide by the operable member. Therefore, an initial urging force (initial load) of the urging member can be adjusted according to a material of a workpiece by changing an initially-compressed amount (initially-deformed amount) of the urging member.

According to a second aspect of the present invention, provided is a die-pressing punch used for die-pressing a workpiece, the die-pressing punch comprising: a hollow cylindrical punch guide; a punch body provided inside the punch guide vertically movably (movably in a vertical direction) and non-rotatable about an axial center thereof (axial center of the die-pressing punch) and non-rotatable about an axial center thereof with respect to the punch guide; a punch head provided at an upper end of the punch body by being screw-fitted therewith; a roller unit provided inside the punch guide beneath (on a lower side of) the punch body vertically movably and having a rotatable roller protruding downward from a bottom face of the punch guide; an urging member provided inside the punch guide between the punch body and the roller unit and urging the roller unit downward; a ring-shaped joint member provided on a side of an outer circumferential surface of the punch body and on an upper side of the punch guide and jointed with the punch head non-rotatably about the axial center; and an operable member (a switcher member) for switching the joint member between a rotatable state and a non-rotatable state about the axial center with respect to the joint member.

It is preferable that a plurality of engagement depressed portions depressed toward an outer side in a radial direction are formed on an inner circumferential surface of the joint member or an inner circumferential surface of the punch head at intervals along a circumferential direction, and the operable member is provided on the punch head or the joint member movably in the radial direction and has a hook portion capable of engaging with the engagement depressed portions.

It is preferable that the operable member disengages the hook portion from the engagement depressed portion by an pressing operation thereof to turn the punch head into the rotatable state about the axial center with respect to the joint member, and engages the hook portion with any of the engagement depressed portions when the pressing operation is released to turn the punch head into the non-rotatable state about the axial center with respect to the joint member.

It is preferable that the die-pressing punch further comprises a stripper spring provided between the joint member and the punch guide on the side of the outer circumferential surface of the punch body for keeping a distance between the punch head and the punch guide in a vertical direction.

According to the second aspect of the present invention, the punch head is turned from the non-rotatable state to the rotatable state about the axial center with respect to the joint member by the operable member. Then, the punch head is turned into its rotatable state about the axial center with respect to the punch guide (the punch body). Subsequently, by rotating the punch head, the punch body is slightly moved upward or downward (moved in the vertical direction) with respect to the punch guide due to a screw-fitting function of the punch head and the punch body. Further, the joint member is reset from the rotatable state to the non-rotatable state about the axial center with respect to the punch guide by the operable member. Therefore, an initial urging force (initial load) of the urging member can be adjusted according to a material of a workpiece by changing an initially-compressed amount (initially-deformed amount) of the urging member.

According to a third aspect of the present invention, provided is a die-pressing punch used for die-pressing a workpiece, the die-pressing punch comprising: a hollow cylindrical punch guide; a roller unit provided inside the punch guide vertically movably and having a rotatable roller protruding downward from a bottom face of the punch guide; an urging member provided inside the punch guide on an upper side of the roller unit and urging the roller unit downward; and a pressing member provided inside the punch guide on an upper side of the urging member and pressing the urging member downward, a height position of the pressing member, with respect to the punch guide, being configured to be adjustable.

It is preferable that the die-pressing punch further comprises a lock mechanism that fixes the height position of the pressing member with respect to the punch guide.

According to the third aspect of the present invention, the height position of the pressing member with respect to the punch guide is adjusted. Therefore, an initial urging force (initial load) of the urging member can be adjusted according to a material of a workpiece by changing an initially-compressed amount (initially-deformed amount) of the urging member.

It is preferable that, in the die-pressing punch according to the present invention, a gauge mark that indicates the initial urging force of the urging member is provided on an outer circumferential surface of the punch guide.

It is preferable that, in the die-pressing punch according to the present invention, the urging member is a spring.

It is preferable that, in the die-pressing punch according to the present invention, the roller is a ball roller, and the roller unit is a free ball bearing.

According to a further aspect of the present invention, provided is a die-pressing die set comprising: a die-pressing punch according to the present invention; and a die-pressing die, wherein the ball roller is an upper ball roller, the roller unit is an upper roller unit, and the die-pressing die includes a die body on whose upper face a die hole is formed, and a lower free ball bearing disposed within the die hole and having a rotatable lower ball roller protruding upward from the upper face of the die body.

According to a further aspect of the present invention, provided is a method for beveling an end edge of a workpiece by use of a die-pressing die set according to the present invention, the method comprising: in a state where the end edge of the workpiece is nipped by the upper ball roller of the die-pressing punch and the lower ball roller of the die-pressing die, moving the die-pressing die set relatively to the workpiece in a horizontal direction along the end edge of the workpiece, wherein, when beveling is done at a corner of the end edge of the workpiece, the die-pressing die set is shifted, relatively to the workpiece, forward and backward in a horizontal direction that divides an intersecting angle of two sides regulating the corner.

According to the present invention, it becomes possible to set it at a working load in accordance with a material of a workpiece without adjusting the height position of the striker every time when changing a material of a workpiece, and thereby operational efficiency of die-pressing can be improved.

DESCRIPTION OF EMBODIMENTS

Figure 1:
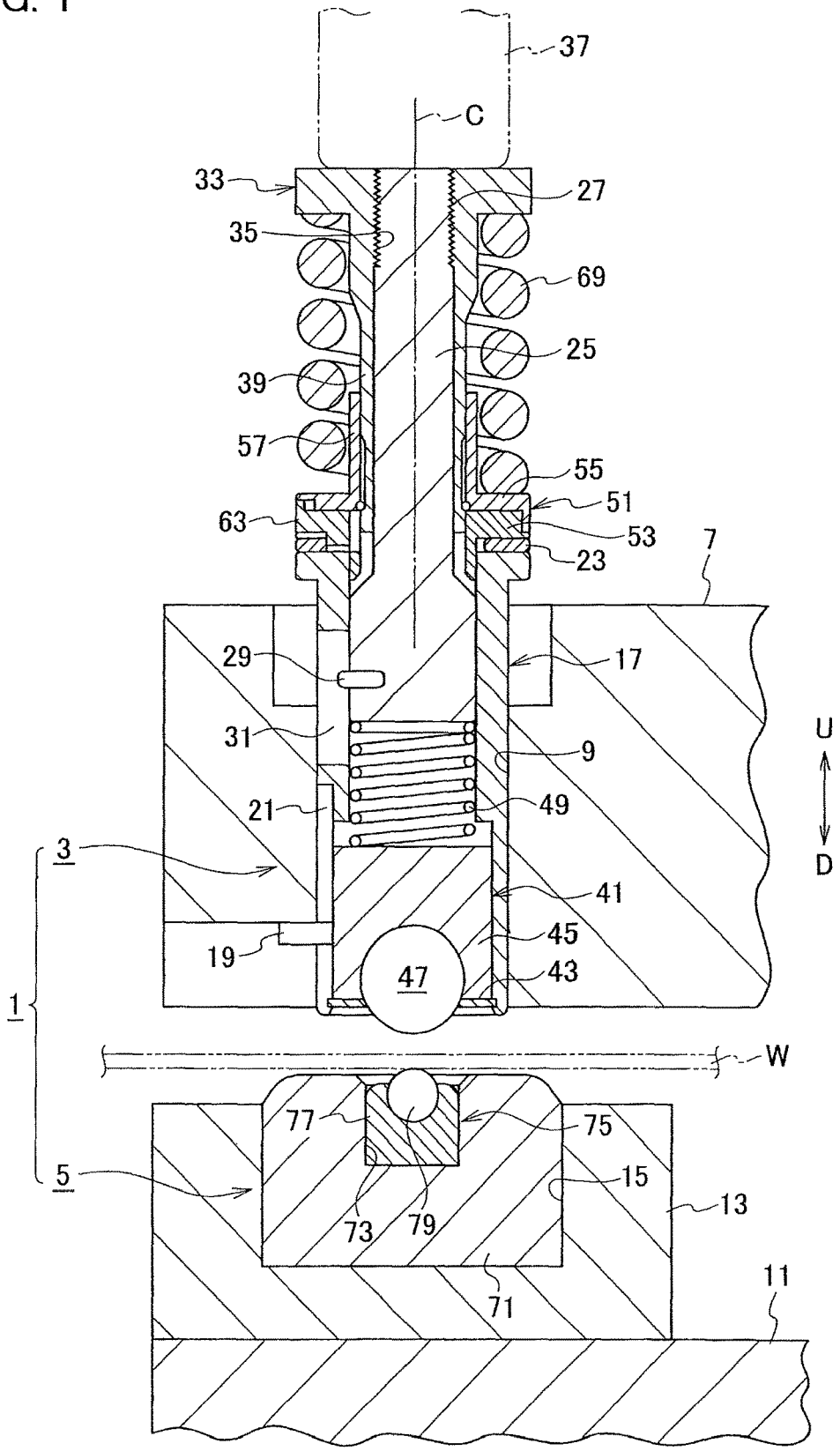
FIG. 1 is a cross-sectional view showing a die-pressing die set (including its surroundings) according to an embodiment of the present invention.

An embodiment and another embodiment according to the present invention will be described with reference to the drawings.

Note that an "axial center" indicates an axial center of a die-pressing punch, and, in other words, indicates an axial center of a punch guide or a punch body. A radial direction" indicates a radial direction of a die-pressing punch, in other words, indicates a radial direction of a direction of a punch guide or a punch guide. In the drawings, a "U" indicates an upward direction, a "D" indicates a downward direction, an "R" indicates the radial direction, an "Ri" indicates an inner side in the radial direction, and an "Ro" indicates an outer side in the radial direction.

Embodiment According to the Present Invention

Figure 2:
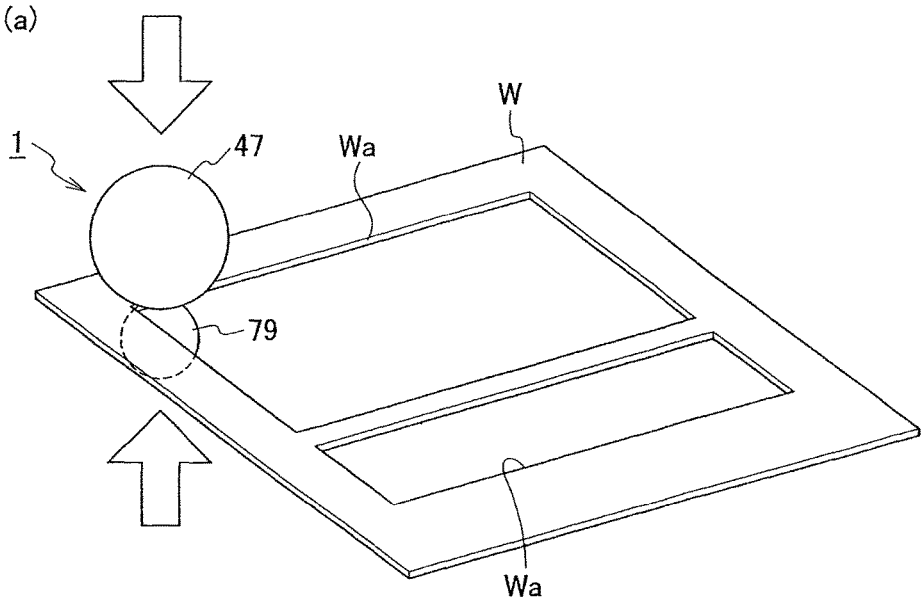
FIG. 2(*a*) is a schematic perspective view showing a state where beveling is done with the die-pressing die set according to the embodiment of the present invention, and FIG. 2(*b*) is a state where marking is done with the die-pressing die set according to the embodiment of the present invention.
Figure 2:
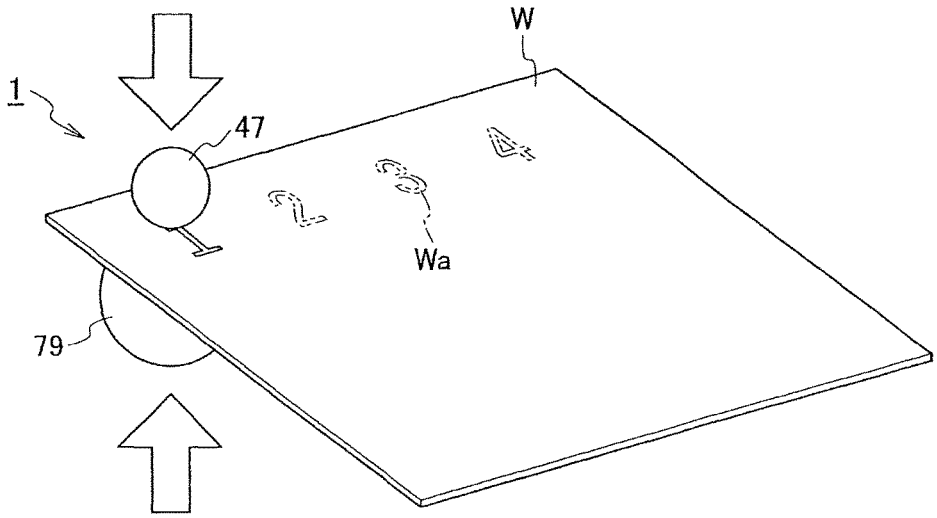

As shown in FIG. 1 and FIGS. 2(*a*) and (*b*), a die-pressing die set 1 according to an embodiment of the present invention is used when carrying out die-pressing such as beveling and marking on a plate-shaped workpiece W, and configured of a die-pressing punch 3 and a die-pressing die 5. In addition, the die-pressing punch 3 is held detachably in an installation hole 9 of an upper turret 7, which serves as an upper hold base in a punch press. The die-pressing die 5 is held detachably in an installation hole 15 of a die holder 13 attached to a lower turret 11, which serves as a lower hold base in the punch press.

Next, detailed configurations of the die-pressing punch 3 according to the embodiment of the present invention will be explained.

Figure 3:
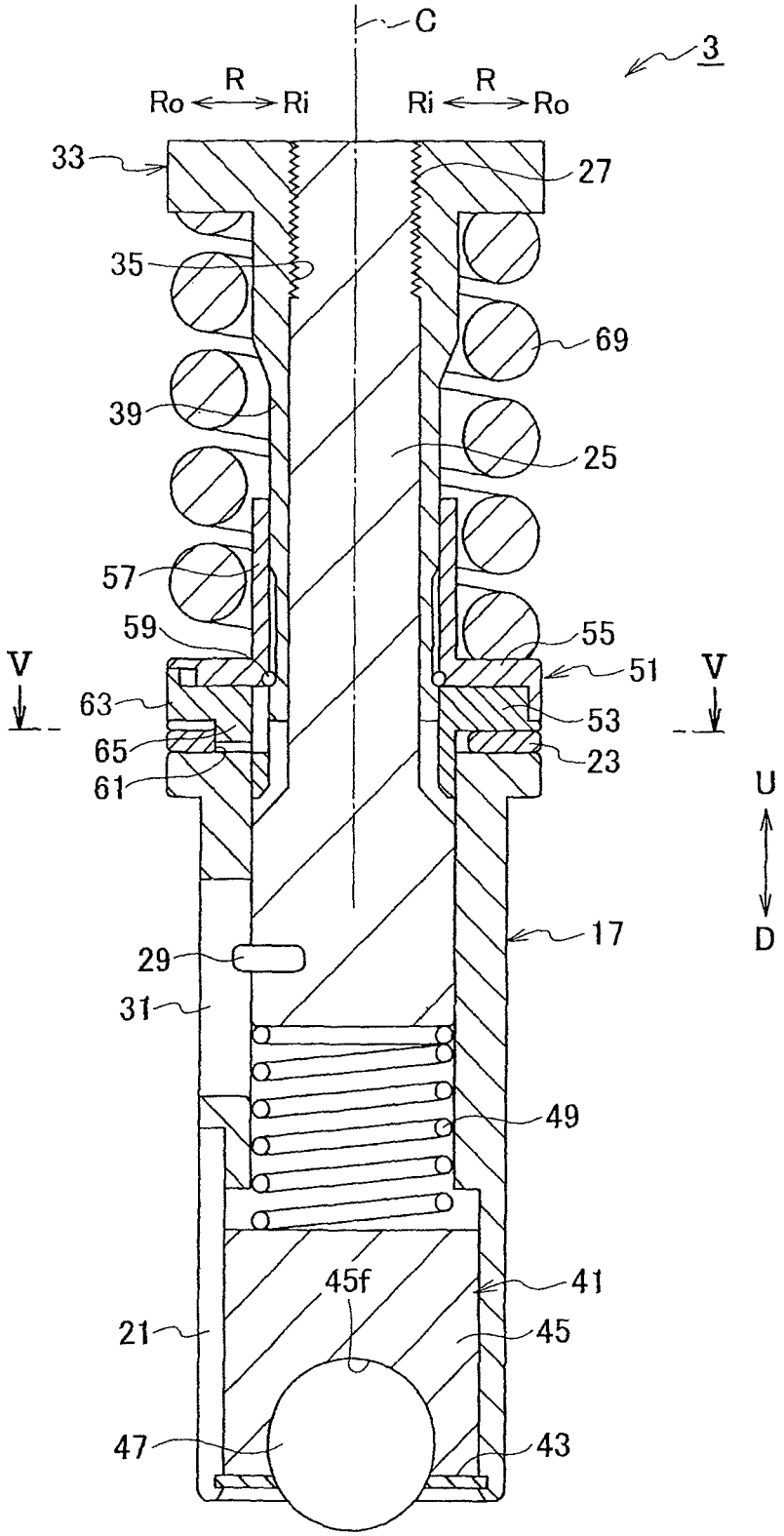
FIG. 3 is a cross-sectional view showing a die-pressing punch according to the embodiment of the present invention.
Figure 4:
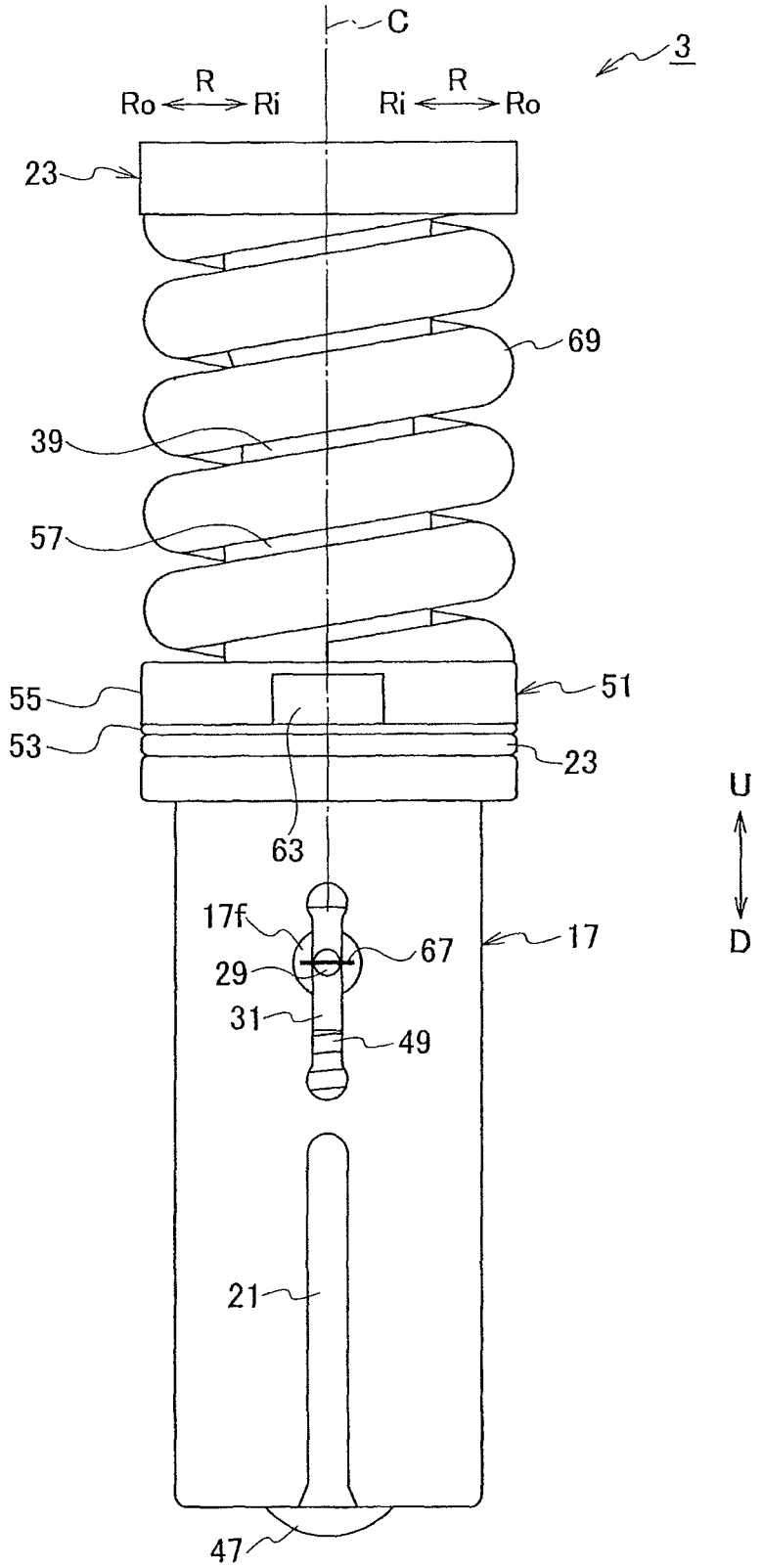
FIG. 4 is a side view showing the die-pressing punch according to the embodiment of the present invention.

As shown in FIG. 1, FIG. 3 and FIG. 4, the die-pressing punch 3 includes a hollow cylindrical punch guide 17, and the punch guide 17 is held in the installation hole 9 of the upper turret 7 vertically movably (movably in a vertical direction) and detachably. The punch guide 17 is supported by plural lifter springs (not shown in the drawings) attached along a circumferential edge of the installation hole 9 of the upper turret 7. In addition, the punch guide 17 is configured so as not to be rotatable about an axial center C with respect to the installation hole 9 of the upper turret 7 due to an engaging function of a key 19 and a key slot 21. The key 19 is disposed at an appropriate position on a circumferential edge of the installation hole 9 of the upper turret 7, and the key slot 21 is formed to extend in the vertical direction at an appropriate position on an outer circumferential surface of the punch guide 17. Further, the punch guide 17 has a ring member 23 integrally therewith at its upper end side.

The punch guide 17 includes a punch body 25 in its inside vertically movably, and the punch body 25 has a male threaded portion 27 at its upper end. In addition, the punch body 25 is configured so as not to be rotatable about the axial center C with respect to the punch guide 17 due to an engaging function of a key 29 and a key slot 31. The key 29 is disposed at an appropriate position on an outer circumferential surface of the punch body 25, and the key slot 31 is formed to extend in the vertical direction on an upper side of the key slot 21 on the outer circumferential surface of the punch guide 17. Note that the key 29 may be disposed at an appropriate position on the outer circumferential surface of the punch guide 17 and the key slot 31 may be disposed at an appropriate position on the outer circumferential surface of the punch body 25.

The punch body 25 includes a ring-shaped punch head 33 screw-fitted with its upper end (the male threaded portion 27), and the punch head 33 has a female threaded portion 35 screw-fitted with the male threaded portion 27 on its inner side. The punch head 33 is to be pressed (struck) from above by a striker 37 in the punch press. In addition, the punch head 33 has a pipe portion 39 integrally therewith on its lower side, and the pipe portion 39 extends downward toward the punch guide 17. Here, when the punch head 33 is rotated, the punch body 25 slightly moves vertically (moves in the vertical direction) with respect to the punch guide 17 due to a screw-fitting function of the punch head 33 and the punch body 25. In other words, a height position of the punch body 25 with respect to the punch guide 17 is configured to be adjustable. A distance between the upper end of the punch head and the upper end of the punch guide 17 is kept at a constant distance (a given distance).

The punch guide 17 includes a upper free ball bearing 41, which serves as an upper roller unit, beneath (on a lower side of) the punch body 25 in its inside vertically movably. The upper free ball bearing 41 is made non-removable from the bunch guide 17 by a snap ring 43 installed on an inner circumferential surface of a lower end of the punch guide 17. In addition, the upper free ball bearing 41 includes a unit main body 45 provided inside the punch guide 17 vertically movably, and the unit main body 45 has a support surface 45*f* depressed hemispherically at its lower portion. Further, the upper free ball bearing 41 has an upper ball roller (upper roller having a spherical shape) 47 provided rotatably on the support surface 45*f* of the unit main body 45 via plural small balls (not shown in the drawings). The upper ball roller 47 protrudes downward from a bottom face of the punch guide 17.

The punch guide 17 includes a coil spring 49 as an urging member that urges the upper free ball bearing 41 downward, between the punch body 25 and the upper free ball bearing 41 in its inside. Here, the punch body 25 functions as a pressing member for pressing the coil spring 49 downward. Note that a gas spring (not shown in the drawings) or an elastic member such as urethane (a kind of the urging member) may be used instead of using the coil spring 49 as the urging member.

The punch body 25 includes a ring-shaped joint member 51 on a side of its outer circumferential surface and on an upper side of the punch guide 17 (between the punch guide 17 and the punch head 33). The joint member 51 has a ring-shaped retainer 53 non-detachably provided at the upper end of the punch guide 17 via stopper screws (not shown in the drawings), and a ring-shaped spring seat 55 integrally provided with the retainer 53. The spring seat 55 has a pipe portion 57 at its upper side, and the pipe portion 57 extends upward toward the punch head 33. In addition, the pipe portion 57 of the spring seat 55 is (configured to be) jointed with the pipe portion 39 of the punch head 33 non-rotatably about the axial center C by a spline joint or the like. The spring seat 55 is configured to be non-removable with respect to the pipe portion 39 of the punch head 33 by a snap ring 59 installed at a lower end of the pipe portion 39 of the punch head 33. In other words, the joint member 51 is (configured to be) jointed with the punch head 33 non-rotatably about the axial center C and non-removably therefrom.

Figure 5:
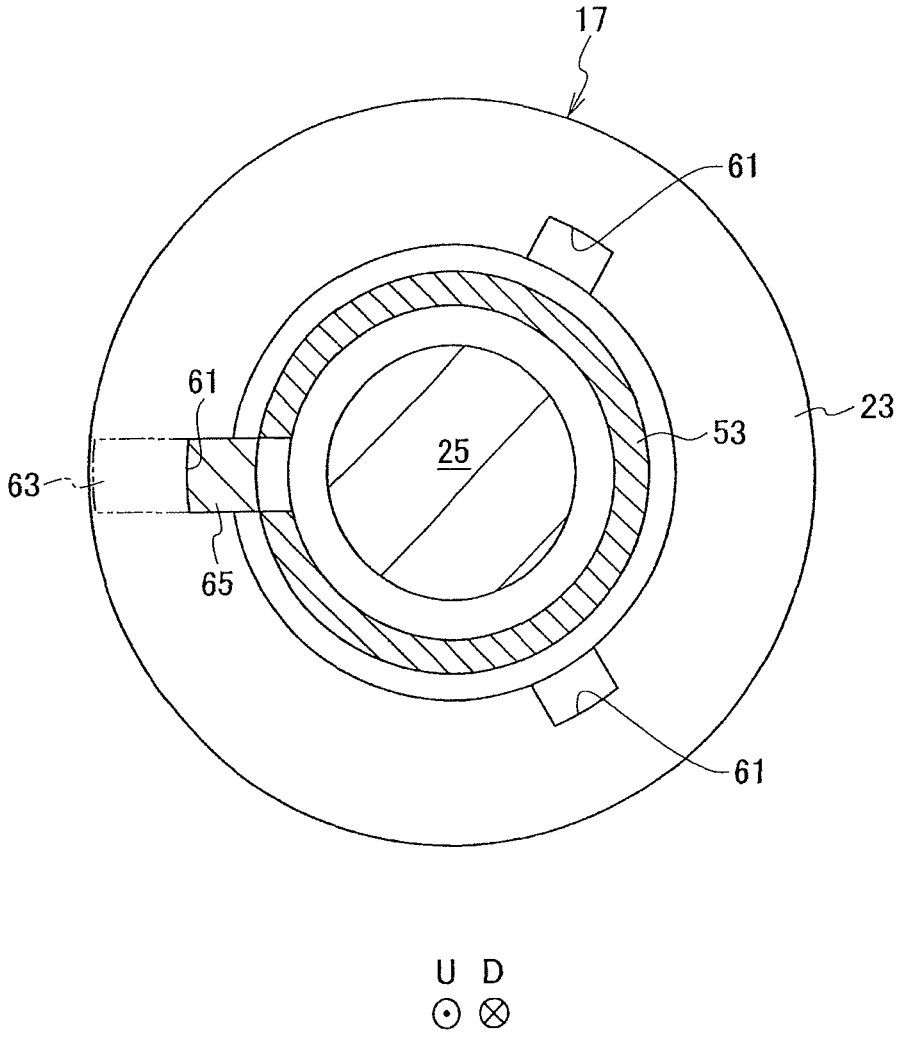
FIG. 5 is an enlarged cross-sectional view taken along a line V-V in FIG. 3.

As shown in FIG. 3 and FIG. 5, plural engagement depressed portions 61 depressed toward an outer side in the radial direction are formed on an inner circumferential surface of the ring member 23, which is an upper portion of the punch guide 17, at intervals along its circumferential direction. In addition, the joint member 51 includes an operable member (a switcher member) 63 movable in the radial direction at part thereof along the circumferential direction. Further, the operable member 63 is operable by being pressed toward an inner side in the radial direction, and is urged toward an outer side in the radial direction by a spring (not shown in the drawings). The operable member 63 has a hook portion 65 capable of engaging with the engagement depressed portion(s) 61 at its end.

Then, the operable member 63 disengages the hook portion 65 from the engagement depressed portion 61 by its pressing operation, and thereby turns the joint member 51 into a rotatable state about the axial center C with respect to the punch guide 17. The operable member 63 engages the hook portion 65 with any of the engagement depressed portions 61 when the pressing operation (the pressed state) is released, and thereby turns the joint member 51 into a non-rotatable state about the axial center C with respect to the punch guide 17. In other words, the operable member 63 switches the joint member 51 between the rotatable state and the non-rotatable state, about the axial center C with respect to the punch guide 17. Here, the plural engagement depressed portions 61, the operable member 63 and so on function as a lock mechanism that fixes the height position of the punch body (pressing member) 25 with respect to the punch guide 17.

Note that the plural engagement depressed portion 61 may be formed on an inner circumferential surface of the joint member 51 at intervals along its circumferential direction instead of being formed on the inner circumferential surface of the ring member 23 which is an upper portion of the punch guide 17. In this case, the operable member 63 is provided at part of an upper end portion of the punch guide 17 along its circumferential direction instead of being provided at part of the joint member 51 along its circumferential direction.

As shown in FIG. 3 and FIG. 4, the punch guide 17 is provided with a counterbore face (counterbore portion) 17*f* at a portion associating with the key slot 21 on its outer circumferential surface. The punch guide 17 includes, on the counterbore face 17*f*, a gauge mark 67 that indicates a relative height position of the punch body 25 with respect to the punch guide 17. In other words, the gauge mark 67 that indicates an initial load (initial urging force) of the coil spring 49 is provided at the position associating with the key slot 21 on the outer circumferential surface of the punch guide 17.

The punch body 25 includes, between the punch head 33 and the spring seat 55 on a side of its outer circumferential surface, a stripper spring 69 for keeping a distance, in the vertical direction, between the punch head 33 and the punch guide 17 at a given distance. The stripper spring 69 also has a function for keeping a distance, in the vertical direction, between the upper end of the punch head 33 and the joint member 51 at a given distance. Note that a tubular spacer (not shown in the drawings) may be used instead of the stripper spring 69.

Next, configurations of the die-pressing die 5 according to the embodiment of the present embodiment will be explained.

Figure 6:
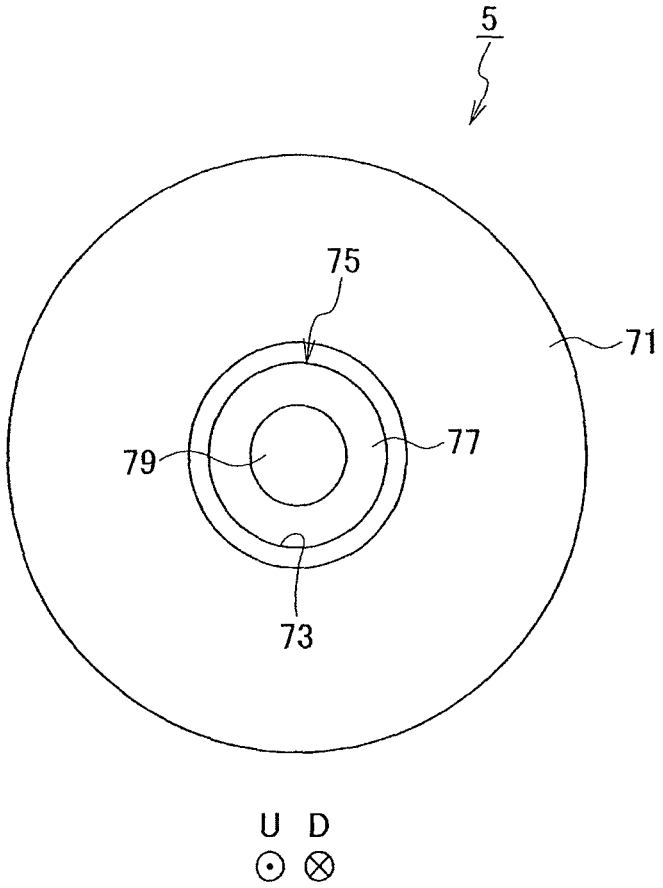
FIG. 6(*a*) is a plan view showing the die-pressing die according to the embodiment of the present invention, and FIG. 6(*b*) is a cross-sectional view showing the die-pressing die according to the embodiment of the present invention.
Figure 6:
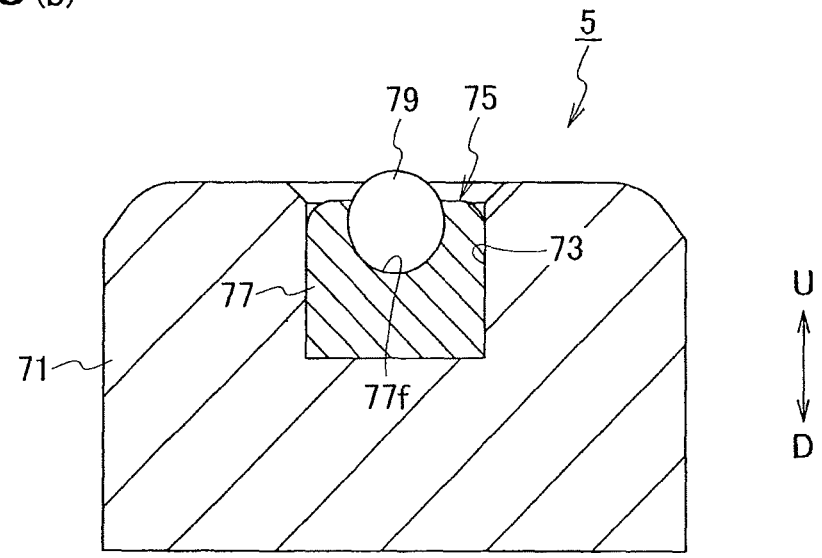

As shown in FIG. 1 and FIGS. 6(*a*) and (*b*), the die-pressing die 5 includes a cylindrical die body (die main body) 71, and the die body 71 is held detachably in the installation hole 15 of the die holder 13. A die hole 73 is formed at a center portion of an upper surface of the die body 71.

The die body 71 includes a lower free ball bearing 75, which serves as a lower roller unit, within the die hole 73. The lower free ball bearing 75 has a unit main body 77 provided inside the die hole 73 of the die body 71, and the unit main body 77 has a support surface 77*f* depressed hemispherically at its upper portion. Further, the lower free ball bearing 75 has a lower ball roller (lower roller having a spherical shape) 79 provided rotatably on the support surface 77*f* of the unit main body 77 via plural small balls (not shown in the drawings). The lower ball roller 79 protrudes upward from an upper face of the die body 71.

Here, the lower free ball bearing 75 smaller-sized than the upper free ball bearing 41 is shown as an example in FIG. 1, but the lower free ball bearing 75 identical-sized to the upper free ball bearing 41 or larger-sized than the upper free ball bearing 41 may be used. In other words, the lower ball roller 79 having a smaller diameter than that of the upper ball roller 47 is shown as an example in FIG. 1, but the lower ball roller 79 having an identical diameter to that of the upper ball roller 47 or a larger diameter than that of the upper ball roller 47 may be used.

Next, actions of the embodiment according to the present invention, including a beveling method according to an embodiment of the present invention, will be explained.

Actions with respect to an adjustment of an initial load of the coil spring 49.

As shown in FIG. 3 to FIG. 5, the hook portion 65 is disengaged from the engagement depressed portion 61 by the pressing operation of the operable member 63, and thereby the joint member 51 is turned from the non-rotatable state to the rotatable state about the axial center C with respect to the punch guide 17. Then, the punch head 33 is turned into its rotatable state about the axial center C with respect to the punch guide 17 (the punch body 25). Subsequently, by rotating the punch head 33, the punch body 25 is slightly moved upward or downward (moved in the vertical direction) with respect to the punch guide 17 (the punch head 33) due to the screw-fitting function of the punch head 33 and the punch body 25. Further, the hook portion 65 is engaged with any of the engagement depressed portions 61 by releasing the pressing operation (the pressed state) of the operable member 63, and thereby the joint member 51 is reset from the rotatable state to the non-rotatable state about the axial center C with respect to the punch guide 17. In other words, the height position of the punch body (pressing member) 25 with respect to the punch guide 17 is adjusted and then fixed. Therefore, the initial load (initial urging force) of the coil spring 49 can be adjusted according to a material of a workpiece W by changing an initially-compressed amount (initially-deformed amount) of the coil spring 49.

Actions with Respect to Beveling

Figure 7:
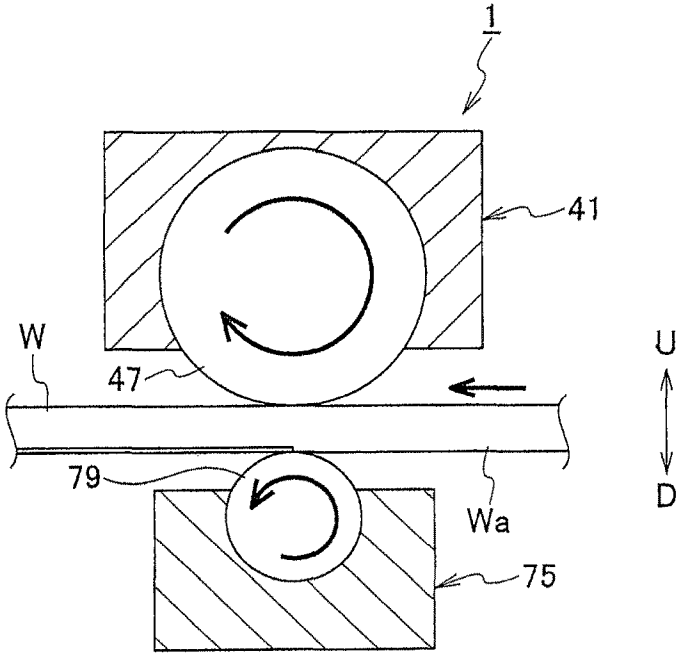
FIG. 7(*a*) is a schematic cross-sectional view explaining actions with respect to beveling with the die-pressing die set according to the embodiment of the present invention, and FIG. 7(*b*) is a schematic cross-sectional view taken along a line VII-VII in FIG. 7(*a*).
Figure 7:
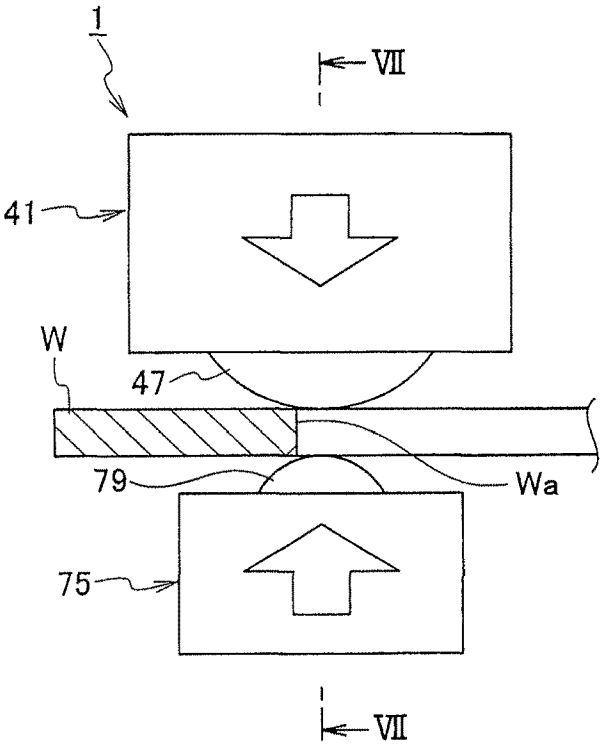

As shown in FIG. 1, FIG. 2(*a*) and FIGS. 7(*a*) and (*b*), a workpiece W is located between the die-pressing punch 3 and the die-pressing die 5 by moving it in the horizontal direction by use of the pie-pressing die set 1 in which a diameter of the lower ball roller 79 is made smaller than that of the upper ball roller 47. Subsequently, the die-pressing punch 3 (the punch guide 17) is moved downward against an urging force of the plural lifter springs by pressing the punch head 33 from above by the striker 37. Then, an end edge Wa that is a worked portion Wa of the workpiece W can be nipped by combination motions of the upper ball roller 47 and the lower ball roller 79. At this moment, the coil spring 49 is compressed by a given amount (e.g. 1 mm) associating with a lower-limit height position of the striker 37, a working load in accordance with a totally-compressed amount of the coil spring 49 calculated by adding the given amount to the initially-compressed amount is exerted. Apex points of the upper ball roller 47 and the lower ball roller 79 are slightly offset (e.g. 0.5 mm) with respect to the end edge Wa of the workpiece W.

After that, the workpiece W is moved relatively to the die-pressing die set 1 in the horizontal direction associating with the end edge (worked portion) Wa. In other words, the die-pressing die set 1 is moved relatively to the workpiece W in the horizontal direction along the end edge Wa of the workpiece W. By this, beveling can be done on a bottom-face side of the end edge Wa of the workpiece W. Even if a position of the workpiece W slightly shifts at this moment, almost a constant pressure (the working load) is applied to the end edge Wa of the workpiece W due to the urging force of the coil spring 49.

Figure 8:
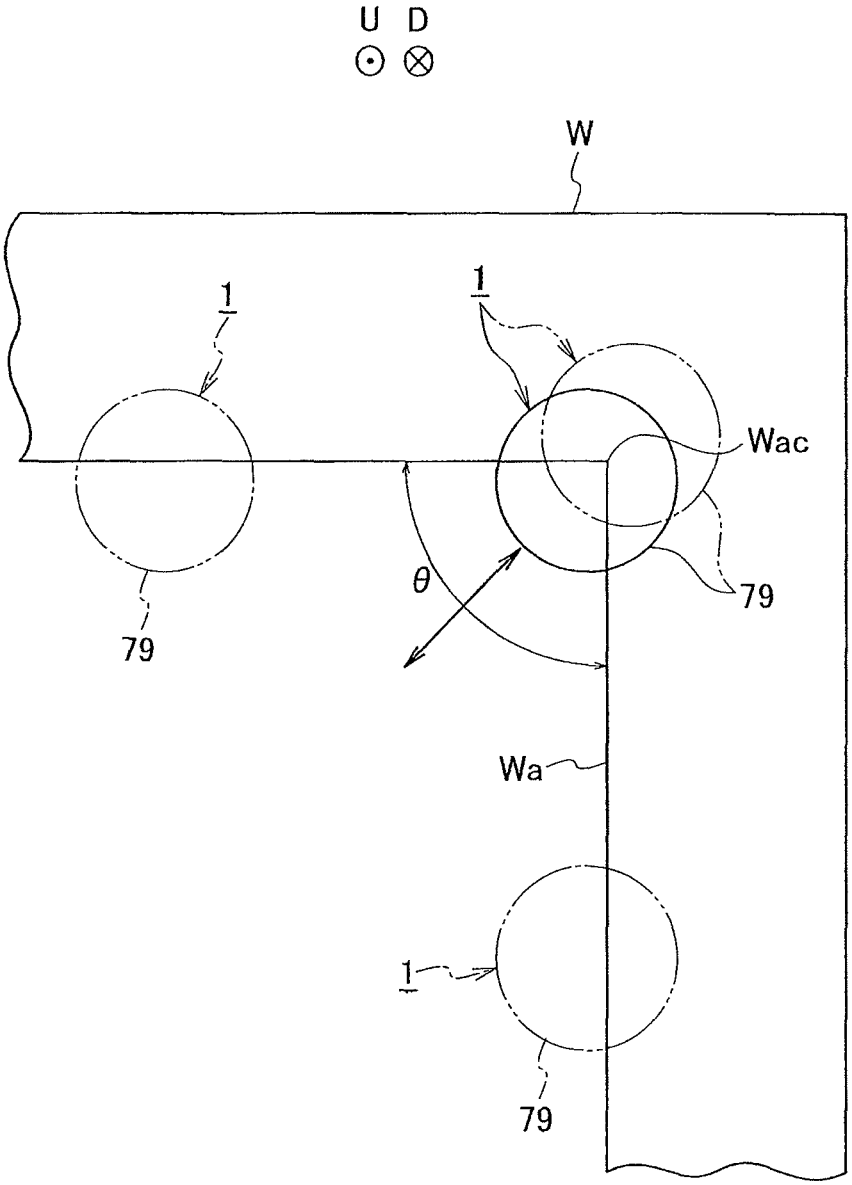
FIG. 8 is a schematic plan view explaining a beveling method in the die-pressing die set according to the embodiment of the present invention.

Especially when beveling is done to a bottom-face side of a corner Wac of the end edge Wa of the workpiece W as shown in FIG. 8, the die-pressing die set 1 is shifted, relatively to the workpiece W, forward and backward in a horizontal direction that bisects an intersecting angle θ of two sides regulating the corner Wac. In other words, as the beveling method according to the embodiment of the present invention, when beveling is done to the bottom-face side of the corner Wac of the end edge Wa of the workpiece W, the die-pressing die set 1 is shifted, relatively to the workpiece W, forward and backward in the horizontal direction that bisects the intersecting angle θ of the two sides regulating the corner Wac. By this, it becomes possible to prevent failure in beveling of the corner Wac of the end edge Wa of the workpiece W. Note that the relative shifting direction of the die-pressing die set 1 may not be the horizontal direction that bisects the intersecting angle θ of the two sides as long as it is a horizontal direction that divides the intersecting angle θ of the two sides.

Figure 9:
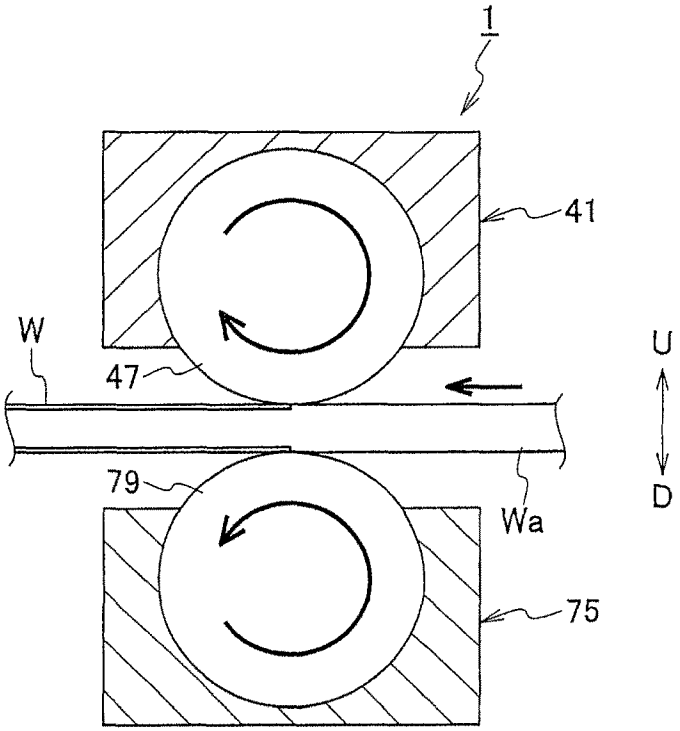
FIG. 9(*a*) is a schematic cross-sectional view explaining actions with respect to beveling with the die-pressing die set according to the embodiment of the present invention, and FIG. 9(*b*) is a schematic cross-sectional view taken along a line IX-IX in FIG. 9(*a*).
Figure 9:
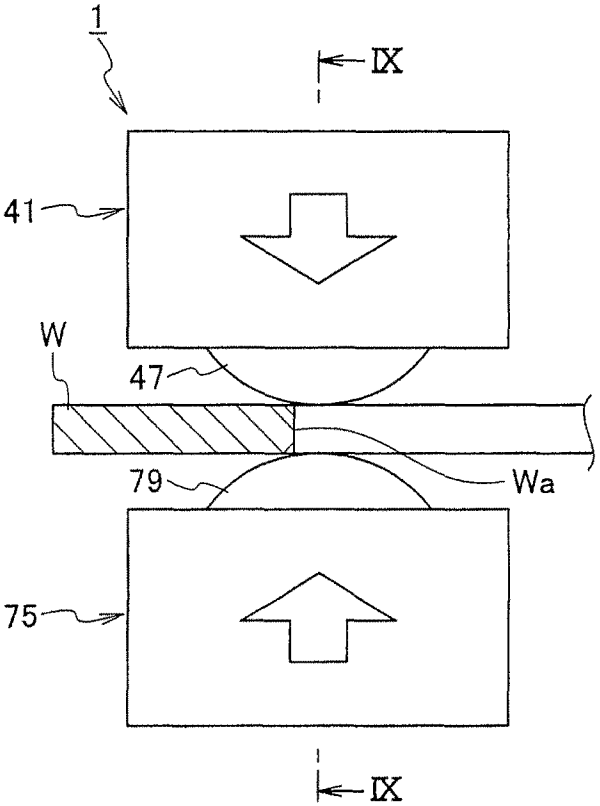

In a case of carrying out beveling on both-face sides (an upper-face side and the bottom-face side) of the end edge Wa of the workpiece W, actions equivalent to the above actions are done by use of the die-pressing die set 1 in which a diameter of the lower ball roller 79 is made equal to that of the upper ball roller 47 as shown in FIGS. 9(*a*) and (*b*).

Actions with Respect to Marking

Figure 10B:
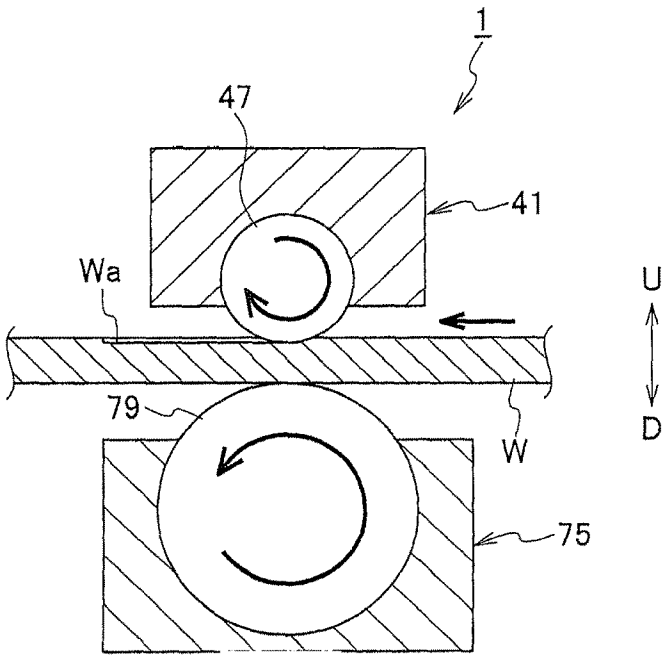
FIG. 10(*a*) is a schematic cross-sectional view explaining actions with respect to marking with the die-pressing die set according to the embodiment of the present invention, and FIG. 10(*b*) is a schematic cross-sectional view taken along a line X-X in FIG. 10(*a*).
Figure 10A:
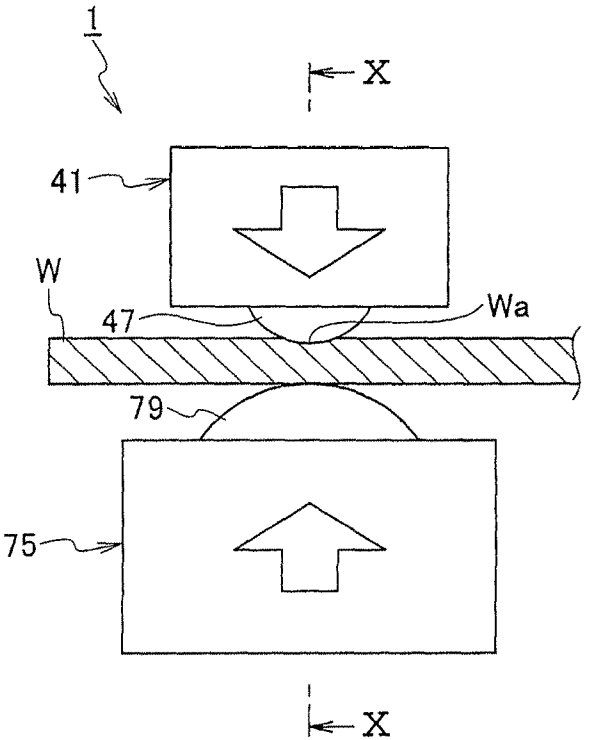

As shown in FIG. 1, FIG. 2(*b*) and FIGS. 10(*a*) and (*b*), a workpiece W is located between the die-pressing punch 3 and the die-pressing die 5 by moving it in the horizontal direction by use of the pie-pressing die set 1 in which a diameter of the lower ball roller 79 is made larger than that of the upper ball roller 47. Subsequently, the die-pressing punch 3 (the punch guide 17) is moved downward against urging forces of the plural lifter springs by pressing the punch head 33 from above by the striker 37. Then, a worked portion Wa of the workpiece W can be nipped by combination motions of the upper ball roller 47 and the lower ball roller 79. At this moment, the coil spring 49 is compressed by a given amount (e.g. 1 mm) associating with a lower-limit height position of the striker 37, a working load in accordance with a totally-compressed amount of the coil spring 49 calculated by adding the given amount to the initially-compressed amount is exerted.

After that, the workpiece W is moved relatively to the die-pressing die set 1 in the horizontal direction associating with the worked portion Wa. In other words, the die-pressing die set 1 is moved relatively to the workpiece W in the horizontal direction along the worked portion Wa of the workpiece W. By this, marking (engraving) can be done on an upper-face side of the worked portion Wa of the workpiece W. Here, a depth of the marking (engraving) can be changed arbitrarily by adjusting the initial load of the coil spring 49.

Figure 11:
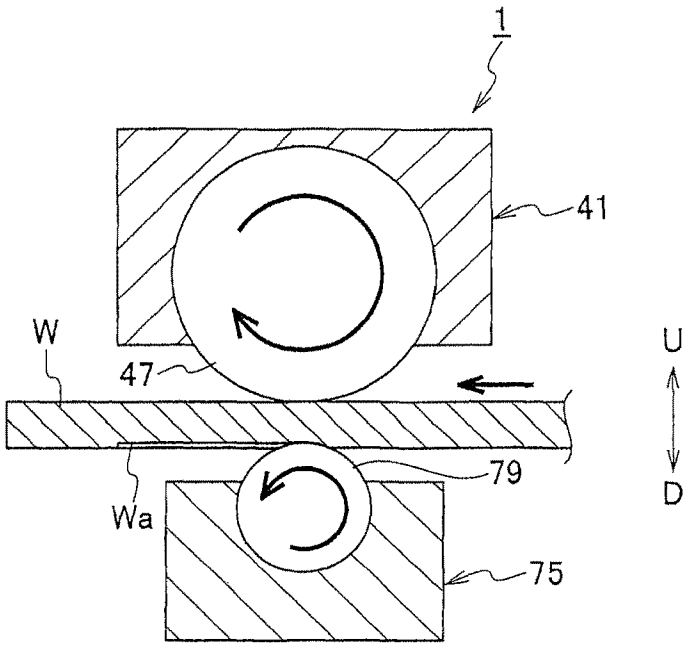
FIG. 11(*a*) is a schematic cross-sectional view explaining actions with respect to marking with the die-pressing die set according to the embodiment of the present invention, and FIG. 11(*b*) is a schematic cross-sectional view taken along a line XI-XI in FIG. 11(*a*).
Figure 11:
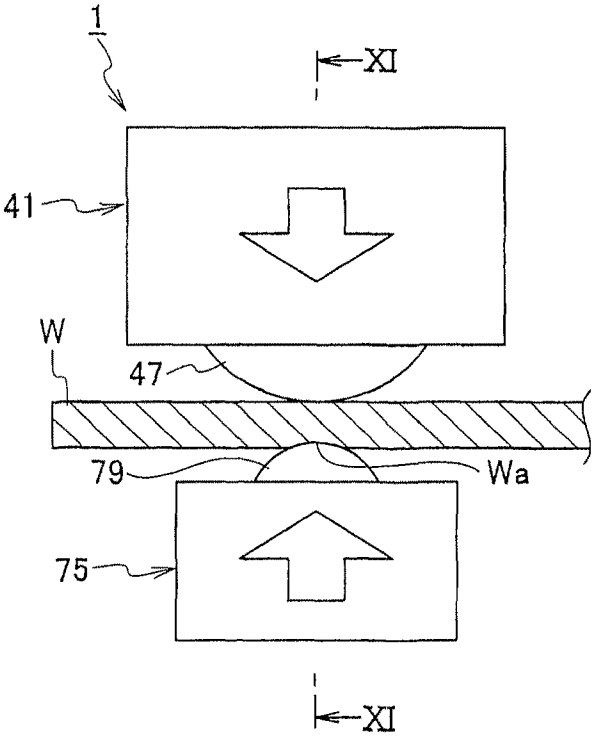

In a case of carrying out marking on a bottom-face side of the worked portion Wa of the workpiece W, actions equivalent to the above actions are done by use of a die-pressing die set 1 in which a diameter of the lower ball roller 79 is made smaller than that of the upper ball roller 47 as shown in FIGS. 11(*a*) and (*b*).

As explained above, according to the embodiment of the present invention, it becomes possible to adjust the initial load of the coil spring 49 according to the material of the workpiece W by changing the initially-compressed amount of the coil spring 49. Therefore, according to the embodiment of the present invention, it becomes possible to set it at the working load in accordance with the material of the workpiece W without adjusting the height position of the striker 37 every time when changing a material of the workpiece W, and thereby operational efficiency of die-pressing such as beveling can be improved.

In addition, as explained above, the joint member is switched between the rotatable state and the non-rotatable state about the axial center C with respect to the punch guide 17 by the operation of the operable member 63 and the release thereof. Therefore, the punch head 33 can be rotated without using any tool, and thereby an adjusting operation of the initial load of the coil spring 49 can be made simplified. In particular, since the gauge mark 67 that indicates the initial load of the coil spring 49 is provided on the outer circumferential surface of the punch guide 17, the adjustment of the initial load of the coil spring 49 can be simplified further.

Another Embodiment

Figure 12:
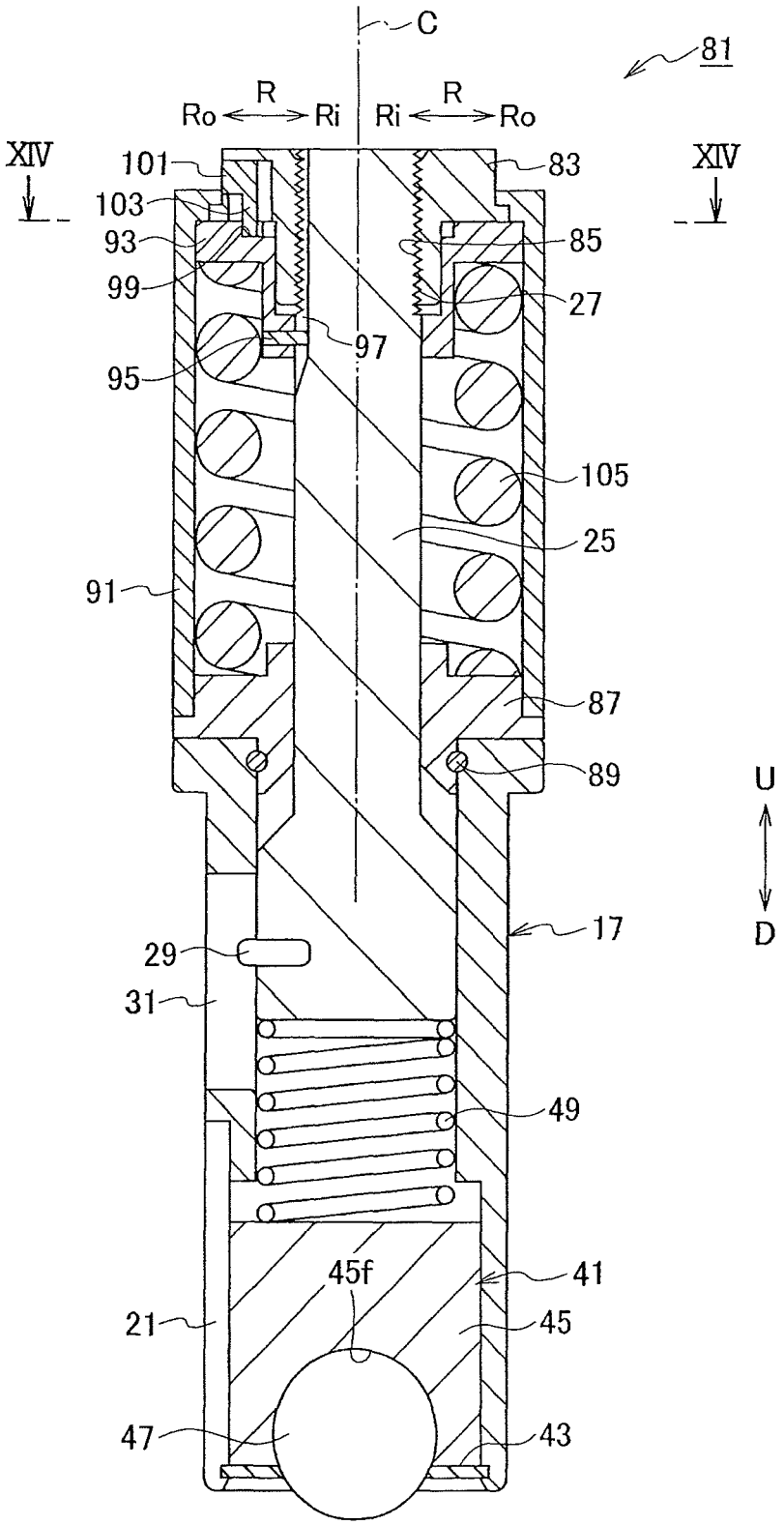
FIG. 12 is a cross-sectional view showing a die-pressing punch according to another embodiment of the present invention.
Figure 13:
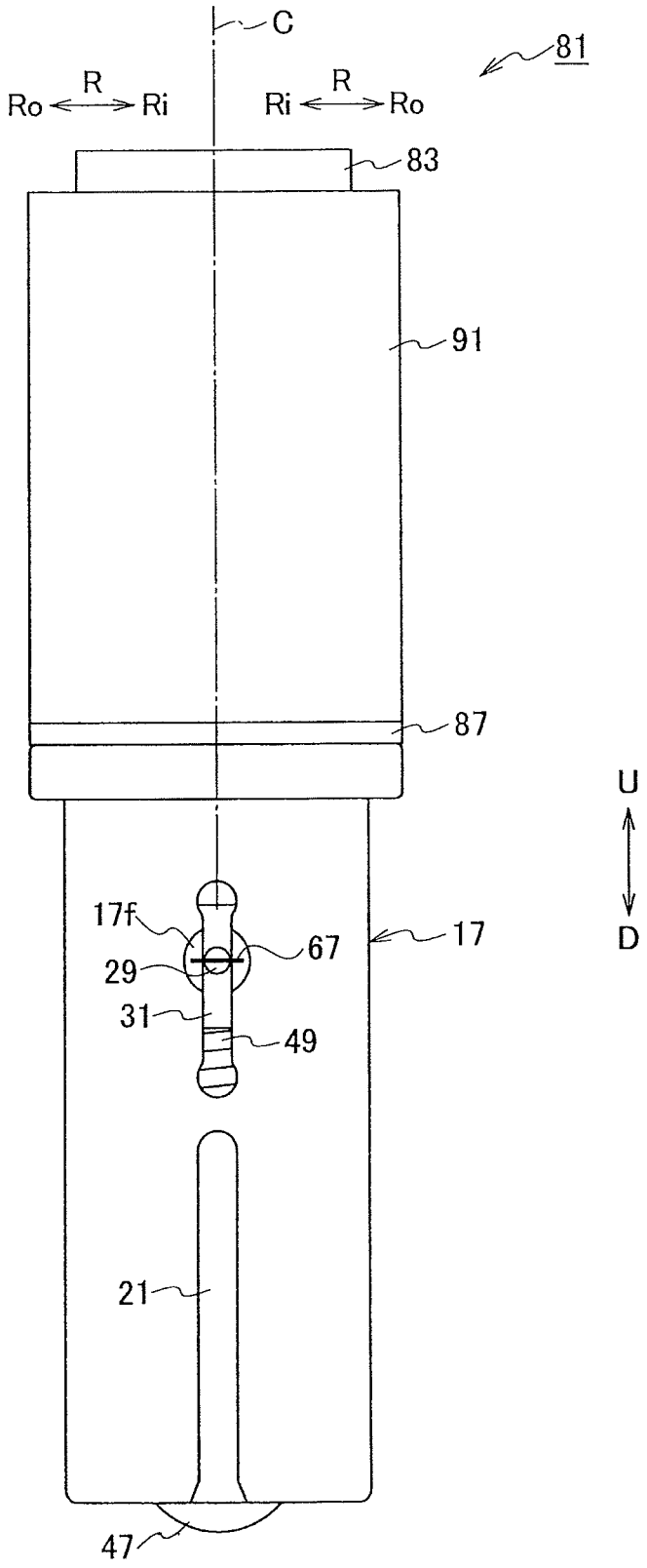
FIG. 13 is a view showing the die-pressing punch according to the other embodiment of the present invention.

In another embodiment according to the present invention, a die-pressing punch 81 shown in FIG. 12 and FIG. 13 is used, instead of the die-pressing punch 3 (see FIG. 1), as a configurational element of the die-pressing die set 1 (see FIG. 1). Similar to the die-pressing punch 3, the die-pressing punch 81 according to the other embodiment of the present invention includes the punch guide 17, punch body 25, the upper free ball bearing 41, the coil spring 49 and the gauge mark 67. Hereinafter, among configurations of the die-pressing die 81, only configurations different from those of the die-pressing punch 3 will be explained. Note that, among configurations of the die-pressing punch 81, configurational elements associating with those of the die-pressing punch 3 are labelled with identical reference numbers thereof in the drawings.

In the die-pressing punch 81 as shown in FIG. 12 and FIG. 13, the punch guide 17 doesn't have the ring member 23 integrally therewith at its upper end side. In addition, the punch body 25 includes a ring-shaped punch head 83 screw-fitted with its upper end (the male threaded portion 27), and the punch head 83 has a female threaded portion 85 screw-fitted with the male threaded portion 27 on its inner side. Here, when the punch head 83 is rotated, the punch body 25 slightly moves vertically (moves in the vertical direction) with respect to the punch guide 17 due to a screw-fitting function of the punch head 83 and the punch body 25. In other words, a height position of the punch body 25 with respect to the punch guide 17 is configured to be adjustable. A distance between the upper end of the punch head 83 and the upper end of the punch guide 17 is kept at a constant distance (a given distance).

The punch body 25 includes a ring-shaped retainer 87 on a side of its outer circumferential surface and on an upper side of the punch guide 17, and the retainer 87 is made non-removable from the bunch guide 17 by interposing an O ring that serves as an anti-pullout member therebetween. In addition, the retainer 87 includes a holder sleeve 91 on a side of its outer circumferential surface, and the holder sleeve 91 extends upward toward the punch head 83. An upper end of the holder sleeve 91 holds the punch head 83 rotatably in the axial center C.

The punch body 25 includes a ring-shaped joint member 93 on a side of its outer circumferential side and on a lower side of the punch head 83. The joint member 93 is (configured to be) jointed with the punch body 25 non-rotatably about the axial center C due to an engaging function of a key 95 and a key slot 97. The key 95 is disposed an appropriate position on the joint member 93, and the key slot is formed to extend in the vertical direction at an appropriate position on an outer circumferential surface of the punch body 25. Note that the key 95 may be disposed at an upper end portion of the punch body 25 and the key slot 97 may be formed at an appropriate position on an inner circumferential surface of the joint member 93.

Figure 14:
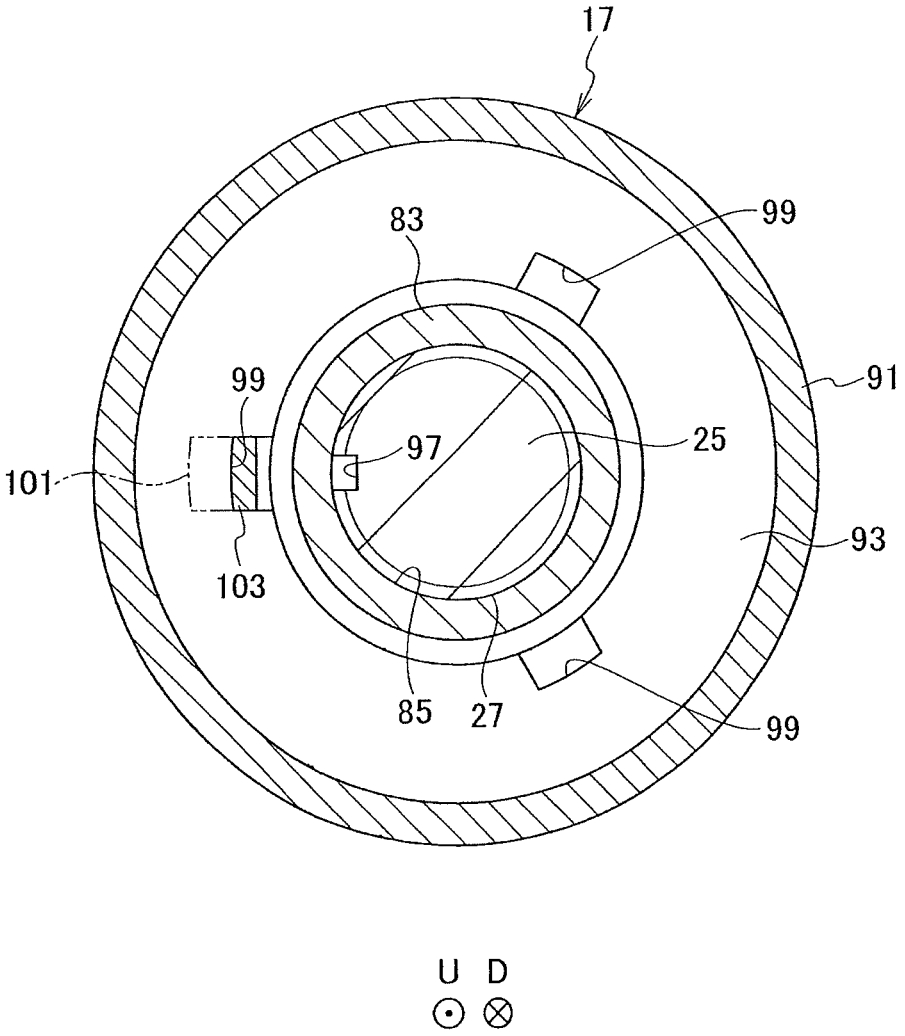
FIG. 14 is a cross-sectional view taken along a line XIV-XIV line in FIG. 12.

As shown in FIG. 12 and FIG. 14, plural engagement depressed portions 99 depressed toward an outer side in the radial direction are formed on an inner circumferential surface of the joint member 93. In addition, the punch head 83 includes an operable member (a switcher member) 101 movable in the radial direction at part thereof along the circumferential direction. Further, the operable member 101 is operable by being pressed toward an inner side in the radial direction, and is urged toward an outer side in the radial direction by a spring (not shown in the drawings). The operable member 101 has a hook portion 103 capable of engaging with the engagement depressed portion(s) 99 at its end.

Then, the operable member 101 disengages the hook portion 103 from the engagement depressed portion 99 by its pressing operation, and thereby turns the punch head 83 into a rotatable state about the axial center C with respect to the joint member 93. The operable member 101 engages the hook portion 103 with any of the engagement depressed portions 99 when the pressing operation (the pressed state) is released, and thereby turns the punch head 83 into its non-rotatable state about the axial center C with respect to the joint member 93. In other words, the operable member 101 switches the punch head 83 between the rotatable state and the non-rotatable state, about the axial center C with respect to the joint member 93. Here, the plural engagement depressed portions 99, the operable member 101 and so on function as a lock mechanism that fixes the height position of the punch body (pressing member) 25 with respect to the punch guide 17.

Note that the plural engagement depressed portion 99 may be formed on an inner circumferential surface of the punch head 83 at intervals along its circumferential direction instead of being formed on the inner circumferential surface of the joint member 93. In this case, the operable member 101 is provided at part of the joint member 93 along its circumferential direction instead of being provided at part of the punch head 83 along its circumferential direction.

As shown in FIG. 12 and FIG. 13, the punch body 25 includes, between the joint member 93 and the retainer 87 on a side of its outer circumferential surface, a stripper spring 105 for keeping a distance, in the vertical direction, between the punch head 83 and the punch guide 17 at a given distance. The stripper spring 105 also has a function for keeping a distance, in the vertical direction, between the joint member 93 and the punch guide 17 at a given distance. Note that a tubular spacer (not shown in the drawings) may be used instead of the stripper spring 105.

Next, actions of the other embodiment according to the present invention will be explained.

Actions with respect to the adjustment of the initial load of the coil spring 49

As shown in FIG. 12 to FIG. 14, the hook portion 103 is disengaged from the engagement depressed portion 99 by the pressing operation of the operable member 101, and thereby the punch head 83 is turned from the non-rotatable state to the rotatable state about the axial center C with respect to the joint member 93. Then, the punch head 83 is turned into its rotatable state about the axial center C with respect to the punch the punch body 25. Subsequently, by rotating the punch head 83, the punch body 25 is slightly moved upward or downward (moved in the vertical direction) with respect to the punch guide 17 (the punch head 83) due to the screw-fitting function of the punch head 83 and the punch body 25. Further, the hook portion 103 is engaged with any of the engagement depressed portions 99 by releasing the pressing operation of the operable member 101, and thereby the punch head 83 is reset from the rotatable state to the non-rotatable state about the axial center C with respect to the joint member 93. In other words, the height position of the punch body (pressing member) 25 with respect to the punch guide 17 is adjusted and then fixed. Therefore, the initial load (initial urging force) of the coil spring 49 can be adjusted according to a material of a workpiece W by changing the initially-compressed amount (initially-deformed amount) of the coil spring 49.

Note that actions similar to the actions with respect to beveling and the actions with respect to marking that have been described above are brought also in the other embodiment according to the present invention.

Therefore, also in the other embodiment of the present invention, effects equivalent to those of the embodiment according to the present invention can be brought.

Note that the present invention is not limited to the embodiment and the other embodiment explained above, and can be carried out in various embodiments as explained below.

Instead of the upper free ball bearing 41, another upper roller unit (not shown in the drawings) having an upper roller (not shown in the drawings) rotatable about a horizontal or vertical rotational axis. In this case, instead of the lower free ball bearing 75, another lower roller unit (not shown in the drawings) having a lower roller (not shown in the drawings) rotatable about a horizontal or vertical rotational axis is used.

In addition, a claimed scope contained in the present invention is not limited to the above-explained embodiments.

The invention claimed is:

1. A die-pressing punch used for die-pressing a workpiece, the die-pressing punch comprising:

a hollow cylindrical punch guide;

a punch body provided inside the punch guide vertically movably and non-rotatable about an axial center thereof with respect to the punch guide;

a punch head provided at an upper end of the punch body by being screw-fitted therewith;

a roller unit provided inside the punch guide beneath the punch body vertically movably and having a rotatable roller protruding downward from a bottom face of the punch guide;

an urging member provided inside the punch guide between the punch body and the roller unit and urging the roller unit downward;

a ring-shaped joint member provided on a side of an outer circumferential surface of the punch body and on an upper side of the punch guide and jointed with the punch head non-rotatably about the axial center; and an operable member for switching the joint member between a rotatable state and a non-rotatable state about the axial center with respect to the punch guide, wherein an initial load of the urging member is adjusted by adjusting and then fixing a height position of the punch body with respect to the punch guide to change an initially-compressed amount of the urging member.

2. The die-pressing punch according to claim 1, wherein a plurality of engagement depressed portions depressed toward an outer side in a radial direction are formed on an inner circumferential surface of an upper end portion of the punch guide or on an inner circumferential surface of the joint member at intervals along a circumferential direction, and the operable member is provided on the joint member or at the upper end portion of the punch guide movably in the radial direction and has a hook portion capable of engaging with the engagement depressed portions.

3. The die-pressing punch according to claim 2, wherein the operable member disengages the hook portion from the engagement depressed portion by an pressing operation thereof to turn the joint member into the rotatable state about the axial center with respect to the punch guide, and engages the hook portion with any of the engagement depressed portions when the pressing operation is released to turn the joint member into the non-rotatable state about the axial center with respect to the punch guide.

4. The die-pressing punch according to claim 1, further comprising a stripper spring provided between the punch head and the joint member on the side of the outer circumferential surface of the punch body for keeping a distance between the punch head and the punch guide in a vertical direction.

5. The die-pressing punch according to claim 1, wherein a gauge mark that indicates the initial urging force of the urging member is provided on an outer circumferential surface of the punch guide.

6. The die-pressing punch according to claim 1, wherein the urging member is a spring.

7. The die-pressing punch according to claim 1, wherein the roller is a ball roller, and the roller unit is a free ball bearing.

8. A die-pressing die set comprising:

a die-pressing punch according to claim 7; and a die-pressing die, wherein the ball roller is an upper ball roller, the roller unit is an upper roller unit, and the die-pressing die includes a die body on whose upper face a die hole is formed, and a lower free ball bearing disposed within the die hole and having a rotatable lower ball roller protruding upward from the upper face of the die body.

9. A method for beveling an end edge of a workpiece by use of a die-pressing die set according to claim 8, the method comprising:

in a state where the end edge of the workpiece is nipped by the upper ball roller of the die-pressing punch and the lower ball roller of the die-pressing die, moving the die-pressing die set relatively to the workpiece in a horizontal direction along the end edge of the workpiece, wherein, when beveling is done at a corner of the end edge of the workpiece, the die-pressing die set is shifted, relatively to the workpiece, forward and backward in a horizontal direction that divides an intersecting angle of two sides regulating the corner.

10. A die-pressing punch used for die-pressing a workpiece, the die-pressing punch comprising:

a hollow cylindrical punch guide;

a punch body provided inside the punch guide vertically movably and non-rotatable about an axial center thereof with respect to the punch guide;

a punch head provided at an upper end of the punch body by being screw-fitted therewith;

a roller unit provided inside the punch guide beneath the punch body vertically movably and having a rotatable roller protruding downward from a bottom face of the punch guide;

an urging member provided inside the punch guide between the punch body and the roller unit and urging the roller unit downward;

a ring-shaped joint member provided on a side of an outer circumferential surface of the punch body and on an upper side of the punch guide and jointed with the punch head non-rotatably about the axial center; and an operable member for switching the joint member between a rotatable state and a non-rotatable state about the axial center with respect to the joint member, wherein an initial load of the urging member is adjusted by adjusting and then fixing a height position of the punch body with respect to the punch guide to change an initially-compressed amount of the urging member.

11. The die-pressing punch according to claim 10, wherein a plurality of engagement depressed portions depressed toward an outer side in a radial direction are formed on an inner circumferential surface of the joint member or an inner circumferential surface of the punch head at intervals along a circumferential direction, and the operable member is provided on the punch head or the joint member movably in the radial direction and has a hook portion capable of engaging with the engagement depressed portions.

12. The die-pressing punch according to claim 11, wherein the operable member disengages the hook portion from the engagement depressed portion by an pressing operation thereof to turn the punch head into the rotatable state about the axial center with respect to the joint member, and engages the hook portion with any of the engagement depressed portions when the pressing operation is released to turn the punch head into the non-rotatable state about the axial center with respect to the joint member.

13. The die-pressing punch according to claim 10, further comprising a stripper spring provided between the joint member and the punch guide on the side of the outer circumferential surface of the punch body for keeping a distance between the punch head and the punch guide in a vertical direction.

14. The die-pressing punch according to claim 10, wherein a gauge mark that indicates the initial urging force of the urging member is provided on an outer circumferential surface of the punch guide.

15. The die-pressing punch according to claim 10, wherein the urging member is a spring.

16. The die-pressing punch according to claim 10, wherein the roller is a ball roller, and the roller unit is a free ball bearing.

17. A die-pressing punch used for die-pressing a workpiece, the die-pressing punch comprising:

a hollow cylindrical punch guide;

a roller unit provided inside the punch guide vertically movably and having a rotatable roller protruding downward from a bottom face of the punch guide;

an urging member provided inside the punch guide on an upper side of the roller unit and urging the roller unit downward;

a pressing member provided inside the punch guide on an upper side of the urging member and pressing the urging member downward, a height position thereof with respect to the punch guide being configured to be adjustable; and a lock mechanism fixing the height position of the pressing member with respect to the punch guide, wherein an initial load of the urging member is adjusted by adjusting and then fixing the height position of the pressing member with respect to the punch guide to change an initially-compressed amount of the urging member.

18. The die-pressing punch according to claim 17, wherein a gauge mark that indicates the initial urging force of the urging member is provided on an outer circumferential surface of the punch guide.

19. The die-pressing punch according to claim 17, wherein the urging member is a spring.

20. The die-pressing punch according to claim 17, wherein the roller is a ball roller, and the roller unit is a free ball bearing.

* * * * *